US007322790B2

(12) United States Patent
Bouru

(10) Patent No.: US 7,322,790 B2
(45) **Date of Patent: *Jan. 29, 2008**

(54) SYSTEM FOR CONTROLLING STAGES OF VARIABLE-PITCH STATOR VANES IN A TURBOMACHINE

(75) Inventor: Michel Andre Bouru, Montereau sur le Jard (FR)

(73) Assignee: SNECMA, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/383,287

(22) Filed: May 15, 2006

(65) Prior Publication Data

US 2006/0263206 A1 Nov. 23, 2006

(30) Foreign Application Priority Data

May 17, 2005 (FR) ..... 05 04918

(51) Int. Cl.
*F01D 9/04* (2006.01)

(52) U.S. Cl. ..... 415/162

(58) Field of Classification Search ..... 415/160, 415/162

See application file for complete search history.

(56) References Cited

U.S. PATENT DOCUMENTS 3,146,585 A * 9/1964 Gulick ..... 60/230
3,779,665 A * 12/1973 Tatem et al. ..... 415/123
4,295,784 A * 10/1981 Manning ..... 415/162
5,044,879 A 9/1991 Farrar

FOREIGN PATENT DOCUMENTS

EP 0 909 880 A2 4/1999
EP 1 489 267 A1 12/2004

OTHER PUBLICATIONS

U.S. Appl. No. 11/383,277, filed May 15, 2006, Bouru.
U.S. Appl. No. 11/383,287, filed May 15, 2006, Bouru.

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A system for controlling two stages of variable-pitch stator vanes of a turbomachine, the system comprising a drive element for turning the control ring of one of the stages via a leader member pivotally mounted on the casing, a synchronization bar for transmitting the turning movement of the ring driven by the drive element to the control ring of the other stage via a follower member pivotally mounted on the casing, and an additional pivot member interposed between the follower member and the follower ring, said additional pivot member being pivotally mounted both on the casing and on the follower member.

8 Claims, 5 Drawing Sheets

SYSTEM FOR CONTROLLING STAGES OF VARIABLE-PITCH STATOR VANES IN A TURBOMACHINE

BACKGROUND OF THE INVENTION

The present invention relates to the general field of controlling stages of variable-pitch vanes in a turbomachine.

In a turbomachine, it is known to use one or more stages of stator vanes for adjusting the flow direction and rate of gas passing through the compression section as a function of the operating speed of the turbomachine. Each such stator vane stage comprises a plurality of vanes (known as variable-pitch vanes) that can pivot about their respective pins connecting them to the stator so that their pitch angle can be modified as a function of the operating speed of the turbomachine.

Known devices for controlling a stage of variable-pitch vanes generally comprise a control member in the form of a ring surrounding the casing of the turbomachine, and a plurality of links or levers, with each link having a first end connected to the control ring via a hinge and a second end mounted on the pivot of a respective vane. A drive actuator is connected to the control ring in order to turn it about the axis of the turbomachine. When the ring turns about the turbomachine axis it causes all of the vanes of the stage to change their angular position synchronously.

When two axially-offset stages of variable-pitch vanes are to be controlled in synchronous manner, it is also known to make use of a synchronization bar to transmit the turning movement from the ring that is driven by the drive actuator to the control ring of the other stage. This transmission of movement takes place via bell cranks pivotally mounted on the casing of the turbomachine and connected firstly to the synchronization bar and secondly to respective ones of the control rings.

That control system generates movements in the various controlled stages that can be represented in the form of curves plotting the pitch angle of the vanes in the follower stage as a function of the pitch angle of the vanes in the leader stage. With a control system of the above-described type, such a curve, referred to as a "correlation" curve, can present a slope that varies, but only progressively. Thus, that type of control system can be used to command vane stages in simple manner only.

Aerodynamic requirements for controlling vane pitch are more and more frequently requiring control relationships that lead to correlation curves that include curves that present a sudden acceleration or deceleration of slope, particularly in their terminal portions.

Document EP 0 909 880 describes a variable-pitch device enabling non-linear control relationships to be obtained. In that device, each link of the leader stage is connected to the corresponding control ring by a connection having a slot and a stud sliding in the slot. Nevertheless, that control system is not fully satisfactory since it does not make it possible to reproduce specifically a correlation curve having a sudden acceleration or deceleration of slope.

OBJECT AND SUMMARY OF THE INVENTION

A main object of the present invention is thus to mitigate such drawbacks by proposing a control system that makes it possible to implement a vane pitch relationship that includes acceleration (or deceleration) in a localized zone of the control path.

To this end, the invention provides a system for controlling two stages of variable-pitch stator vanes of a turbomachine, each stage being formed by a plurality of vanes each of which is pivotally mounted on a casing of the turbomachine, and by a control ring surrounding the casing and connected to each of the vanes of the stage via levers, the control system comprising a drive element for turning the control ring of one of the stages via a leader member pivotally mounted on the casing, and a synchronization bar for transmitting the turning movement of the ring driven by the drive element to the control ring of the other stage via a follower member pivotally mounted on the casing, the system further comprising an additional pivot member interposed between the follower member and the follower ring, said additional pivot member being pivotally mounted both on the casing and on the follower member.

The term "follower" ring is used to mean the control ring that is driven via the follower member.

By using such an additional pivot member, it is possible to cause the movements on the controlled stages to accelerate or to decelerate in a localized zone of the control path. The position of the pivot point on the casing of the additional pivot member depends on the location of said acceleration (or deceleration) on the control path.

According to an advantageous provision of the invention, the additional pivot member has one arm pivotally mounted on a control rod connected to the follower ring, and a guide rod slidably received in a bushing pivotally mounted on the casing.

According to another advantageous provision of the invention, the follower member comprises a first arm pivotally connected to the additional pivot member, and a second arm connected to one end of the synchronization bar.

The pivot point on the casing of the additional pivot member may be disposed inside a circle centered on the pivot point on the casing of the follower member, and having as its radius the first arm of said follower member. This corresponds to an acceleration of the control path.

Alternatively, the pivot point on the casing of the additional pivot member may be disposed outside a circle centered on the pivot point on the casing of the follower member, and having as its radius the first arm of said follower member. This corresponds to a deceleration of the control path.

According to yet another advantageous provision of the invention, the leader member comprises a first arm connected to the ring of the leader stage via a second control rod, a second arm connected to the end of the synchronization bar opposite from its end connected to the follower member, and a third arm connected to the drive element.

BRIEF DESCRIPTION OF THE DRAWINGS

Other characteristics and advantages of the present invention appear from the following description given with reference to the accompanying drawings that show an embodiment without any limiting character. In the figures.

DETAILED DESCRIPTION OF AN EMBODIMENT

Figure 1:
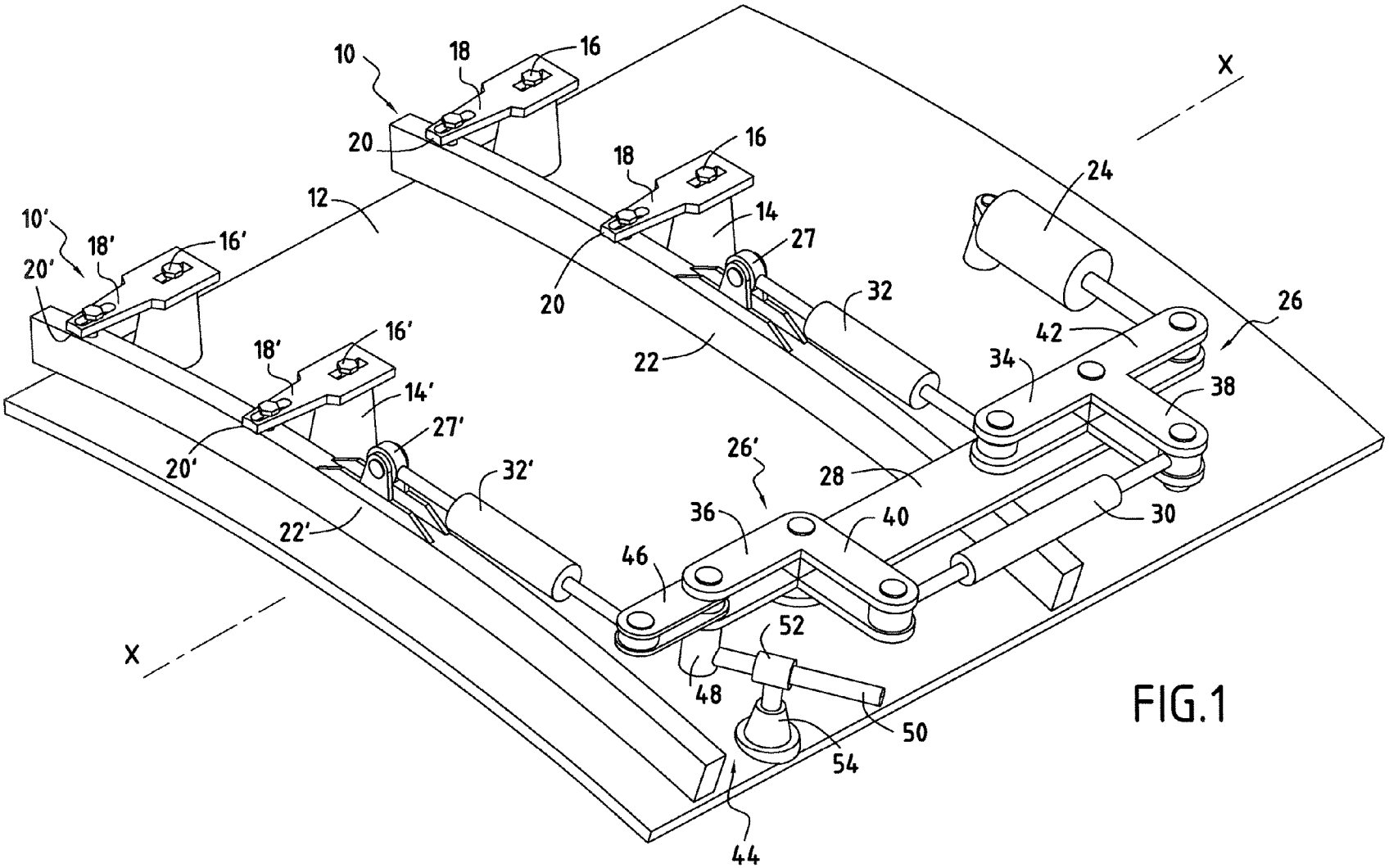
FIG. 1 is a fragmentary perspective view of the control system in an embodiment of the invention.

FIG. 1 shows part of two stages 10, 10' of variable-pitch vanes belonging to a turbomachine compressor, for example. The compressor comprises an annular stator casing 12 (or shroud) centered on the axis X-X of the turbomachine. The stages 10, 10' of vanes are axially offset relative to each other.

Each stage comprises a plurality of vanes 14, 14' disposed radially about the axis X-X of the turbomachine. The vanes 14, 14' are mounted to pivot about respective pins 16, 16' (or pivots) that pass through the casing 12.

Each pin 16, 16' of a variable-pitch vane 14, 14' is connected to one end of a control lever or link 18, 18' whose other end is hinged about a pin 20, 20' projecting radially from a control ring 22, 22'.

The control rings surround the casing 12 and are centered on the axis X-X of the turbomachine. The angular position of the vanes 14, 14' is thus modified in synchronized manner by turning the respective control regions 22, 22' about the axis X-X of the turbomachine.

The system of the invention serves to control the turning of the control rings 22 and 22' about the axis X-X of the turbomachine in synchronized manner. It comprises an actuator type drive element 24 secured to the casing 12 to turn the control ring 22 of one of the stages 10 via a leader member 26 of the bell-crank type which is pivotally mounted on a support 28 on the turbomachine casing 12.

A synchronization bar 30 serves to transmit the turning movement of the ring 22 as driven by the actuator 24 (referred to as the leader ring) to the ring 22' of the other stage 10' (referred to as the follower ring) via a follower member 26' of the bell-crank type which is likewise pivotally mounted on the support 28 of the casing 12.

Control rods 32, 32' of the turnbuckle type serve to transmit the movement from the driver crank 26 and the follower crank 26' to the ring 22, 22'. These rods extend tangentially to the rings to which they are secured via connecting forks 27, 27'. At their opposite ends, the rods 32, 32' are secured to respective arms (or branches) 34, 36 of the leader crank 26 and the follower crank 26', being hinged thereto.

The synchronization bar 30 of the control system unites two other respective arms 38, 40 of the leader crank 26 and the follower crank 26', being hinged thereto. The actuator 24 is hinged to a third arm 42 of the leader crank 26 opposite from the arm 34 to which the rod 32 is secured.

The control system of the invention further comprises an additional pivot member 44 (or additional crank) interposed between the follower member 26' and the follower ring 22'. This additional crank is pivotally mounted both on the casing 12 and on the follower member 26'.

More precisely, the additional crank 44 has a first arm 46 with one end connected to the control rod 32' of the follower ring 22' by being hinged thereto, and its other end is pivotally mounted on the follower crank 26'. The additional crank also has a second arm 48 extending perpendicularly to the first arm 46 along the pivot axis of the additional crank to the follower crank. A guide rod 50 is secured to one end of the second arm 48.

The guide rod 50 of the additional crank 44 is suitable for sliding in a bushing 52 pivotally mounted on the casing 12. The sliding bushing 52 may include recirculating rolling elements. It is pivotally mounted on the casing 12, e.g. using a pivoting support 54 that is brazed to the casing.

Figure 2A:
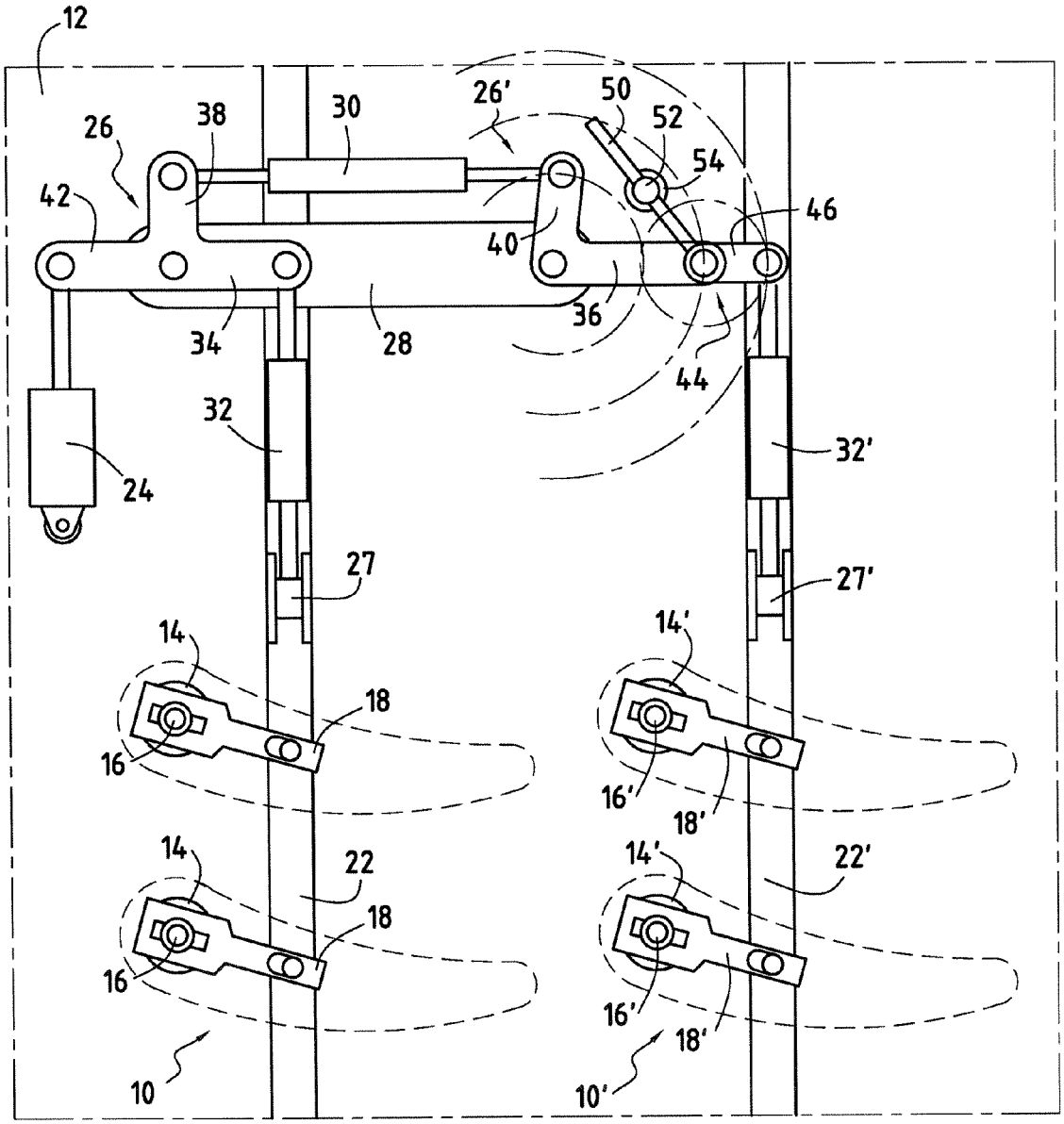
FIGS. 2A, 2B, and 2C show the FIG. 1 control system in two different positions.
Figure 2B:
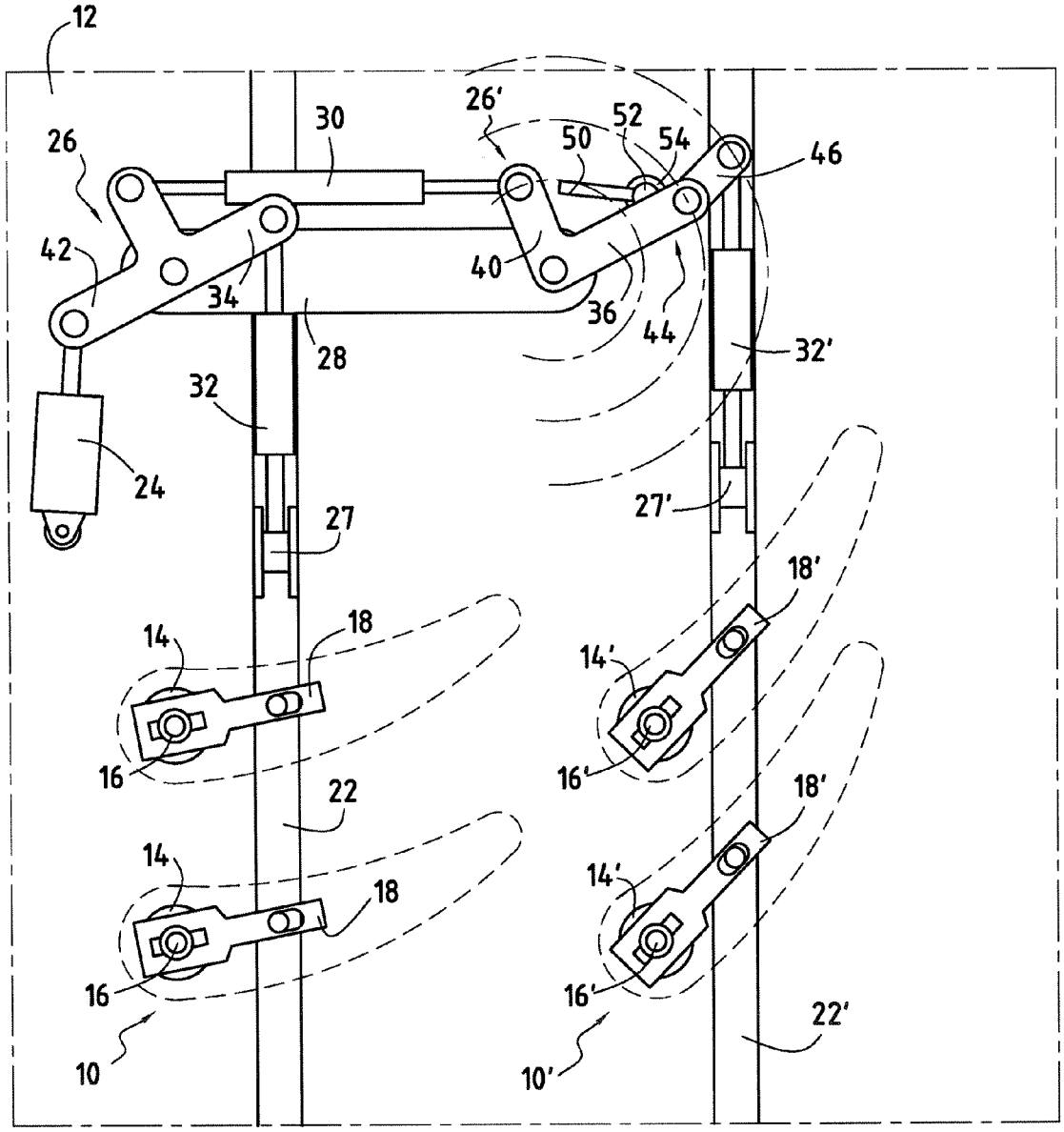

As shown in FIGS. 2A and 2B the control system moves as follows: actuation of the actuator 24 causes the leader crank 26 to turn and likewise causes the follower crank 26' to turn via the synchronization bar 30. The turning of the crank 26 and 26' about their respective pivot points on the casing 12 in turn drives their respective rods 32 and 32', thereby causing the rings 22 and 22' to turn in one direction or the other about the axis X-X of the turbomachine. As mentioned above, turning the rings causes the angular pitch of the vanes 14, 14' in each of the stages 10, 10' to be modified in synchronous manner via the control levers 18, 18'.

Figure 2C:
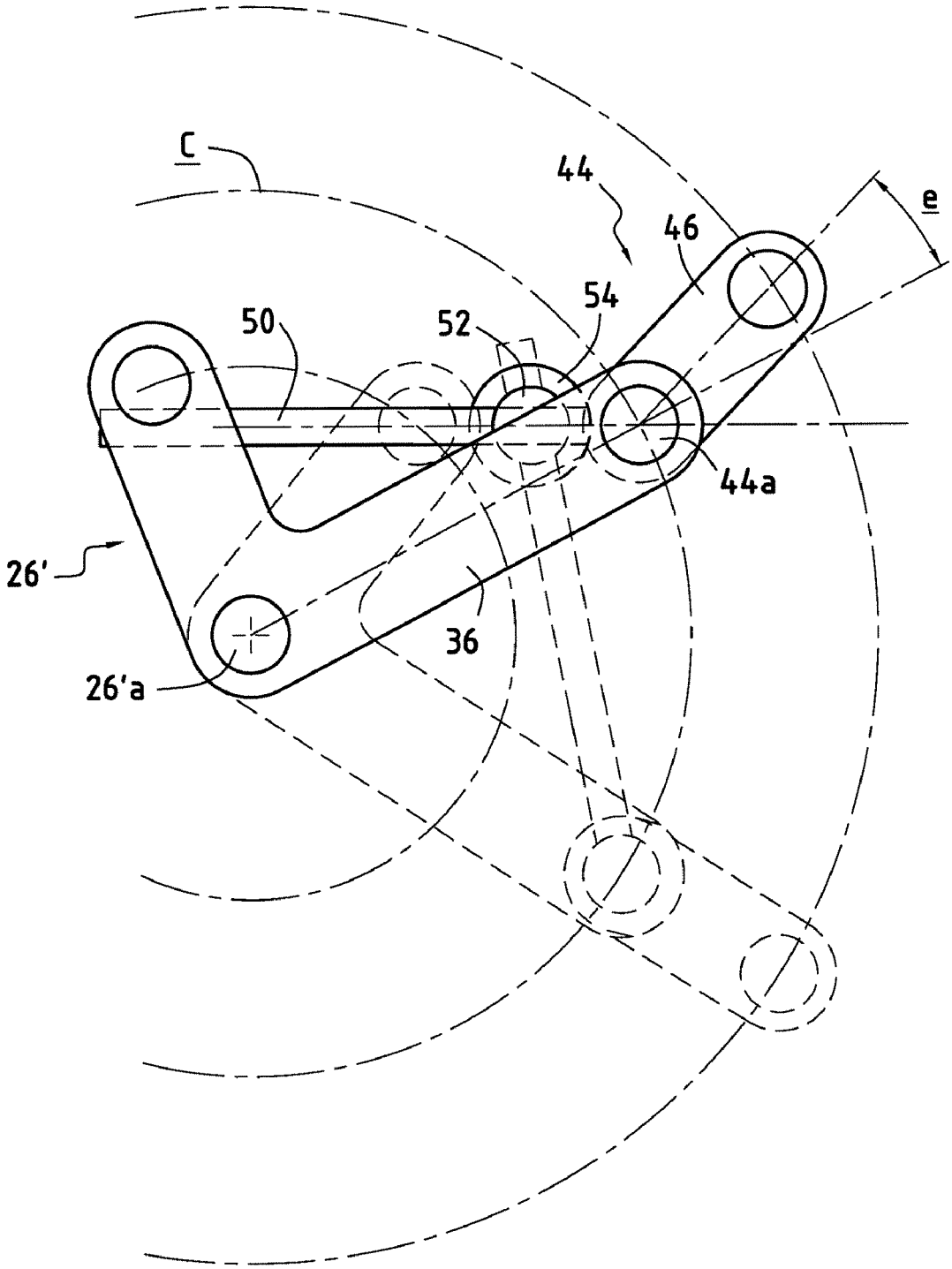

FIG. 2C shows more precisely the movement of the additional crank 44. For reasons of clarity, this figure shows only the follower crank 26' and the additional crank 44 in two extreme positions of the FIG. 1 control system: in dashed lines the system is shown in its open pitch position and in continuous lines the system in its closed pitch position.

The turning of the follower crank 26' about its pivot point 26'*a* on the support on the casing has the effect that the guide rod 50 of the additional crank 44 slides in the bushing 52. Because the bushing 52 is pivotally mounted on the casing, the guide rod 50 can remain continuously in alignment with the sliding axis of the bushing. As the guide rod slides through the bushing, the pivot point 44*a* of the additional crank 44 on the follower crank 26' moves closer to the support 54 of the bushing. Initially, the first arm 46 of the follower crank 44 remains in alignment with the arm 36 of the follower crank 26' on which the additional crank is mounted.

However, from a certain position of the pivot point 44*a* of the additional crank 44, referred to below as the "tipping" position, the guide rod 50 will act by a lever effect to turn the first arm 46 of the additional crank 44 faster about its pivot point 44*a* in the direction of rotation of the follower crank 46'. This accelerated turning of the first arm of the additional crank thus acts via the control rod to accelerate the turning of the follower ring as the pitch closes. The angle e shown in FIG. 2C represents the angular acceleration to which the additional crank 44 is subjected compared with a control system that does not include such a device.

By way of example, the tipping position of the pivot point 44*a* of the additional crank 44 can be defined as being the position from which more than half the length of the guide rod 50 has slid through the bushing 52. This tipping position can be adjusted by modifying the position of the pivoting support 54 on the bushing 52 and/or the length of the guide rod so as to select the zone of the control path that is to be accelerated. This zone could equally well be at the beginning, in the middle, or at the end of the path.

Figure 3:
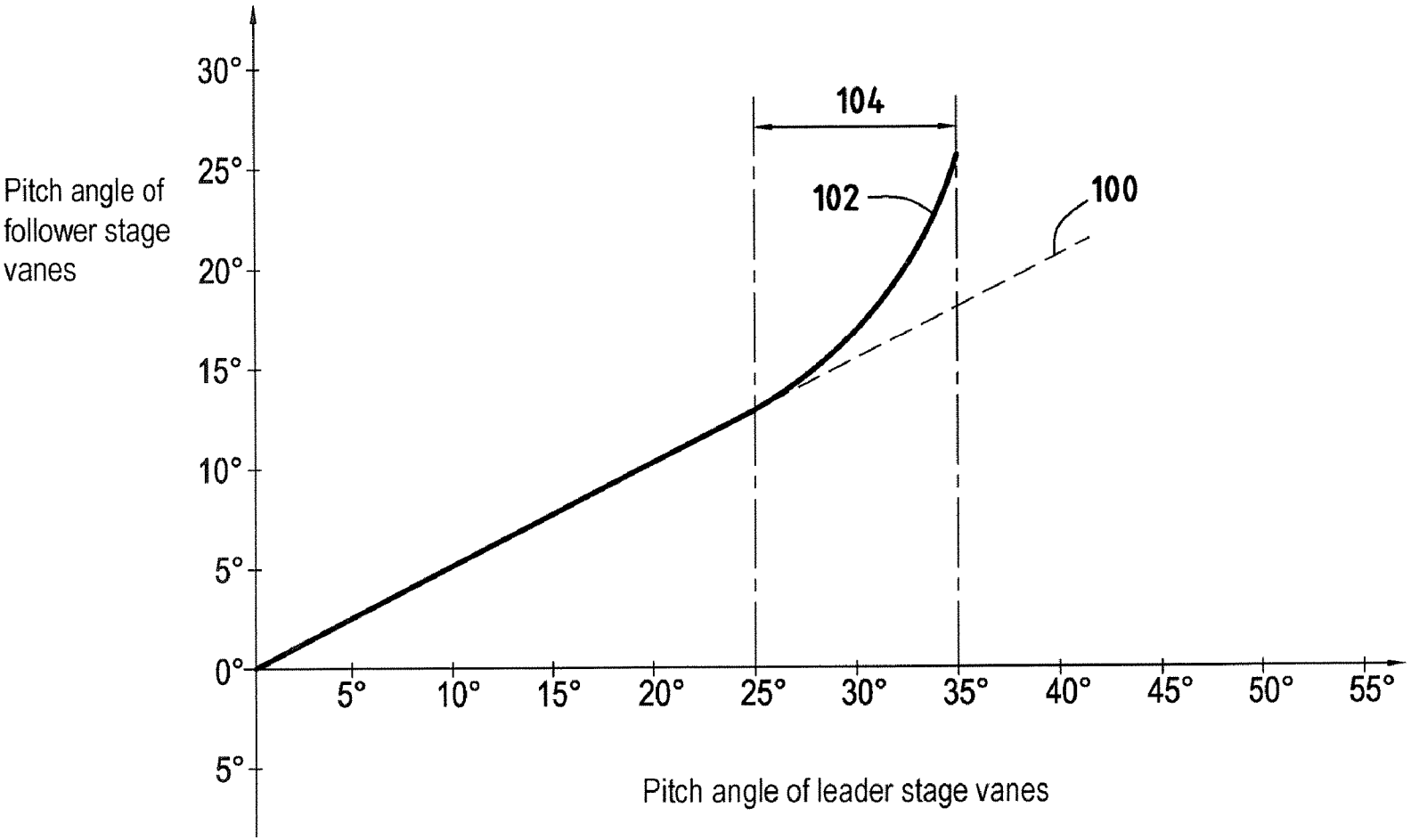
FIG. 3 is a correlation curve showing one possible pitch relationship obtained by the control system of the invention.

FIG. 3 shows the effect of such an acceleration on the pitch relationship of the vanes. The dashed line plots a correlation curve 100 (i.e. a curve giving the pitch angle of the vanes of the follower stage as a function of the pitch angle of the vanes of the leader stage) for a control system that does not include an additional crank, whereas the continuous line curve plots the correlation curve 102 that is established for the control system of the invention.

The correlation curve 100 established for a control system without an additional crank has a slope that is progressive. Relative to this slope, the correlation curve 102 presents a clear acceleration of the pitch angle of the vanes of the follower stage in angle range 104. In this example, the acceleration zone or angle range 104 is at the end of the path, i.e. as the pitch closes. As explained above, it could be located elsewhere.

It should be observed that in the embodiment of FIG. 2C, the pivoting support 54 for the bushing 52 (which corresponds to the pivot point on the casing of the additional crank 44) is disposed inside a circle C centered on the pivot point 26'*a* on the support on the casing for the follower member 26' and having as its radius the arm 36 of the follower member on which the additional crank 44 is mounted. Such a configuration has the consequence of accelerating the control path.

In another configuration that is not shown in the figures, it is also possible to cause the control path to decelerate. Deceleration is obtained by placing the pivot support 54 of the bushing 52 outside the circle C as defined above. Naturally, by changing the position of the pivot support 54 of the bushing 52 so that it lies outside the circle C and/or by changing the length of the guide rod 50, it is also possible to select the zone or angular range of the control path which is to be decelerated (start, middle or end).

Finally, it should be observed that the invention could also be implemented for controlling some larger number of vane stages with a corresponding number of synchronization bars. Depending on the devices chosen, the bars may either be in succession, i.e. interconnecting adjacent cranks, or else in parallel with one another so that they all extend from a common crank.

What is claimed is:

1. A system for controlling two stages of variable-pitch stator vanes of a turbomachine, each stage including a plurality of vanes each pivotally mounted on a casing of the turbomachine, and a control ring for each stage surrounding the casing and connected to each of the vanes of the stage via levers, the control system comprising a drive element for turning a first control ring of one of the stages via a leader member pivotally mounted on the casing, and a synchronization bar for transmitting the turning movement of the first control ring driven by the drive element to a second control ring of the other stage via a follower member pivotally mounted on the casing, the system further comprising an additional pivot member interposed between the follower member and the second control ring, said additional pivot member being pivotally mounted both on the casing and on the follower member.

2. A control system according to claim 1, wherein the additional pivot member has one arm pivotally mounted on a control rod connected to the second control ring, and a guide rod slidably received in a bushing pivotally mounted on the casing.

3. A control system according to claim 1, wherein the follower member comprises a first arm pivotally connected to the additional pivot member, and a second arm connected to one end of the synchronization bar.

4. A control system according to claim 3, wherein the pivot point on the casing of the additional pivot member is disposed inside a circle centered on the pivot point on the casing of the follower member, and has as its radius the first arm of said follower member.

5. A control system according to claim 3, wherein the pivot point on the casing of the additional pivot member is disposed outside a circle centered on the pivot point on the casing of the follower member, and has as its radius the first arm of said follower member.

6. A control system according to claim 3, wherein the leader member comprises a first arm connected to the first control ring via a second control rod, a second arm connected to the end of the synchronization bar opposite from its end connected to the follower member, and a third arm connected to the drive element.

7. A turbomachine compressor comprising at least one system according to claim 1.

8. A turbomachine comprising at least one system according to claim 1.

* * * * *